US008475884B2

(12) United States Patent
Kia

(10) Patent No.: US 8,475,884 B2
(45) Date of Patent: Jul. 2, 2013

(54) COATINGS WITH ORGANIC POLYMERIC FILLERS FOR MOLDED SMC ARTICLES

(75) Inventor: Hamid G. Kia, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 84 days.

(21) Appl. No.: 13/115,144

(22) Filed: May 25, 2011

(65) Prior Publication Data

US 2012/0301627 A1 Nov. 29, 2012

(51) Int. Cl.
*B05D 1/36* (2006.01)

(52) U.S. Cl.
USPC ..... 427/470; 427/475; 427/384; 427/385.5; 427/388.4; 427/372.2

(58) Field of Classification Search
USPC ..... 427/470, 475, 480, 384, 388.4, 385.5, 427/372.2
See application file for complete search history.

(56) References Cited

U.S. PATENT DOCUMENTS

| | | | | |
|---|---|---|---|---|
| 3,993,849 | A * | 11/1976 | Victorius | 428/463 |
| 5,338,578 | A * | 8/1994 | Leach | 427/470 |
| 6,174,405 | B1 * | 1/2001 | Clarke | 156/289 |
| 2008/0146701 | A1 * | 6/2008 | Sain et al. | 524/9 |

* cited by examiner

*Primary Examiner* — Timothy Meeks
*Assistant Examiner* — Ann Disarro
(74) *Attorney, Agent, or Firm* — Reising Ethington P.C.

(57) ABSTRACT

Filler particles of a moisture-permeable, organic polymeric material are used in a polymeric coating composition, and this composition can be applied to a surface of a molded, fiber-reinforced polymeric material, such as sheet molding compound (SMC), to enable the electrostatic application of a layer of a powder primer to the same surface overlying the polymeric coating. And, when the molded SMC is heated to cure the powder primer layer, the out-gassing of moisture from the heated SMC does not result in defects on the surface of the molded SMC.

18 Claims, 1 Drawing Sheet

COATINGS WITH ORGANIC POLYMERIC FILLERS FOR MOLDED SMC ARTICLES

TECHNICAL FIELD

This invention provides a particle-filled polymeric coating composition that is applied to a surface of a molded, sheet molding compound (SMC) article to enable the electrostatic application of a powder primer to the surface. The polymeric coating composition contains electrically conductive particles for the electrostatic application, and particles of a moisture-permeable, organic polymeric material. When the SMC article is heated to cure the powder primer, the particles of organic polymeric material permit moisture driven from the heated SMC article to diffuse through the polymeric coating.

BACKGROUND OF THE INVENTION

Fiber-reinforced polymeric materials are used in the automotive industry to produce a variety of molded interior and exterior parts. Polymeric materials are desirable because, compared to sheet metal, they have a higher strength to weight ratio, are better able to resist corrosion and deterioration from weathering, and have more design flexibility.

Sheet molding compound (SMC) is a commonly used ready-to-mold, fiber-reinforced polyester material. SMC is prepared by dispensing an amount of cut fibers onto a thermosetting resin precursor composition that is carried on a film (usually of nylon or polyethylene). The fibers then disperse into and through the resin composition, and another sheet of film is placed on top of the fiber-resin mixture to sandwich them together and form a contained layer (or package) of SMC composite material. These packages are coiled on a take-up roll and stored to age, or mature, for a time suitable for the viscosity of the composite to reach a level sufficient for molding, typically between two to five days. When the SMC is ready to mold, molding charges are selected or cut from the aged packages and placed between facing, complementary, heated steel dies. Heat and pressure act on each charge to shape and cure it—to activate the polymerization of the thermosetting resin—resulting in solidification of the polymeric material and the formation of a molded SMC article.

A representative SMC resin precursor composition consists of approximately (on a fiber-free basis) 16.9 wt. % thermosetting resin, 2.6 wt. % styrene monomer, 13 wt. % low profile additive, 65 wt. % filler, for example, calcium carbonate, 1.5 wt. % thickener, 0.7 wt. % mold release agent, and 0.3 wt. % polymerization initiator. Reinforcing fibers comprise approximately 27 wt. % of the final SMC composite.

Exterior vehicle body panels are required to have smooth surfaces that are free of visual defects. However, reinforcing fibers in SMC composites tend to create cosmetic problems on the surface of molded SMC articles in the form of waviness, blistering, and porosity. Accordingly, molded SMC articles are typically coated with a suitably thick layer of a primer to fill-in and smooth over these imperfections, followed by one or more paint and gloss layers.

Electrostatic powder coating, instead of solvent-based coating, is a desired method of coating molded SMC articles because it reduces volatile organic compound (VOC) emissions and eliminates material waste. Electrostatic powder coating works by applying an electrostatic charge to the coating particles and to a surface of the article so that the particles accelerate toward the surface. This efficient technique reduces overspray and increases wrap-around of the coating particles, thereby reducing the amount of wasted coating material. Electrostatic powder coating requires the surface of the SMC article to hold an electric charge, but SMC composites are not inherently conductive. As such, a conductive coating composition can be applied to the surface of the SMC article so that the surface can receive and hold an electric charge, and can then be electrostatically powder coated.

Although powder coating of molded SMC articles is a desired and efficient method, this technique produces a surface defect known as "popping" when a layer of a powder primer is electrostatically applied to the SMC article, which is then heated to melt, flow and cure the primer particles. Popping is believed to result from the out-gassing of moisture from the SMC composite during the high-temperature (approximately 350° F.) baking of the powder primer layer. Out-gassing refers, generally, to the formation of bubbles or voids within the cured powder primer layer and on the layer's surface. These bubbles and voids result in a coated surface on the SMC article that is unacceptable for use in the automotive industry. Additionally, popping reduces the life of the SMC article by creating pathways that expose the composite core to environmental conditions.

It has been observed that the more moisture contained within the SMC composite material, the greater the extent of popping. Therefore, it is traditionally thought that such popping can be eliminated by reducing the amount of moisture absorbed by the SMC composite material or by sealing the surface of the molded SMC article to prevent the out-gassing of moisture when the article is heated. As such, conductive coating compositions have been formulated and employed to produce conductive coatings that are impermeable to moisture, for example, through the addition of inorganic platy fillers. However, such compositions have not been able to eliminate popping on the surface of powder-coated SMC composites, and may actually exacerbate popping, particularly when the powder-coated SMC is heated to temperatures above 350° F.

As of today, popping on the surface of powder-coated SMC articles continues to limit the practical use of SMC, especially in the automotive industry. And there is an industry-wide desire for a practical method of eliminating or reducing the extent of such popping.

SUMMARY OF THE INVENTION

In accordance with practices of this invention, a polymeric coating film is applied to surfaces of a molded SMC article. In most applications, this will be the first coating film applied to the molded article. The composition of the polymeric coating is formulated to enable the subsequent electrostatic application of a suitably thick layer of a powder primer and to allow moisture to escape from the SMC article when the powder primer layer is baked.

Accordingly, the polymeric coating comprises a suitable quantity of electrically conductive particles (such as carbon particles) to enable the electrostatic application of the powder primer layer and a suitable quantity of moisture-permeable, organic polymeric filler particles. The binder resin for this polymeric coating may be, for example, a polyurethane system or a mixture of a polyester resin and a melamine resin.

The filler particles are submicron-sized particles of an organic polymeric material that is moisture-permeable and has a melting point above the baking temperature of the powder primer, or temperature at which the primer particles melt and cure (approximately 350° F.). When the powder-coated SMC article is baked, the organic filler particles allow moisture driven from the heated SMC article to diffuse through the polymeric coating and into the overlying powder primer layer without causing defects in the cured primer layer.

The composition of the polymeric coating provides the coating with a coefficient of linear thermal expansion (CLTE) that is compatible with that of the SMC article so that the coating will not tear, wrinkle or deform on the surface of the SMC article when they are jointly heated and cooled. For purposes of comparison, the CLTE of a typical SMC composite is low (within a range of about 10 to $20\times10^{-6}$/° C.).

In a suitable embodiment, the polymeric coating composition comprises approximately 45-55 wt. % polymeric binder resin precursor material, 10-15 wt. % organic filler particles, 5-10 wt. % electrically conductive particles, and the balance an organic solvent.

Suitable filler particles are of a liquid crystal polymer (LCP) that has a melting point above 400° F. and a low CLTE. In a further embodiment, the LCP comprises 27 wt. % 4-hydroxy benzoic acid and 73 wt. % 4-hydroxy 2-naphthoic acid and is commonly known as VECTRA A-950. The melting point of VECTRA A-950 is greater than 530° F. and its average CLTE is very low (lower than aluminum).

In another embodiment, the filler particles are of a cellulose nanofiber. Cellulose nanofibers are isolated by heat treatment from long fiber bundles of hemp, flax, rutabaga, wood or wheat straws. The nanofibers have diameters in the range of about 10 to 70 nanometers, and have been chopped to lengths that are less than one micron.

A suitable thickness of the polymeric coating is in the range of about 20 to 25 μm and produces a surface conductivity, or resistivity, on the SMC article in the range of about 10,000 and 100,000 ohms per inch.

Other objects and advantages of the invention will be apparent from a further description of preferred (but not limiting) embodiments of the invention.

DESCRIPTION OF PREFERRED EMBODIMENTS

As discussed above in this specification, it is desirable to apply an electrically conductive, polymeric coating composition to a surface of an article molded from sheet molding compound (SMC) to enable the subsequent electrostatic application of a layer of powder primer to the same surface. But, a visual defect known as "popping" occurs on the surface of powder-coated SMC articles when the powder primer layer is baked.

SMC composites readily absorb and retain moisture from their surrounding environment. When a moisture-containing SMC article is heated to a high temperature, such as the baking temperature of the powder primer layer, some of the contained moisture will be driven from the heated SMC composite. As the moisture evolves from the SMC it is also be driven through any overlying coatings. This release of moisture from heated SMC articles is referred to as the out-gassing of moisture. And it has been observed that out-gassing moisture from heated SMC articles is responsible for such popping. Out-gassing refers, generally, to the formation of bubbles or voids within the cured primer layer and on the layer's surface.

It is now found that the formation of bubbles and voids in the cured primer layer can be further attributed to the use of inorganic filler particles in conventional conductive coating compositions. Inorganic filler particles of mica, talc, manganese oxide, calcium carbonate and the like are impervious to moisture and comprise up to 40 wt. % of conventional conductive coatings.

In accordance with this invention, filler particles of a moisture-permeable, organic polymeric material are used in a polymeric coating composition, instead of inorganic filler particles. And, when a moisture-absorbing SMC article is coated with this organic filler-containing polymeric coating composition, the filler particles do not lead to the undesirable formation of bubbles or voids in the overlying powder primer layer when the SMC article is baked to cure the powder primer layer.

Figure 1:
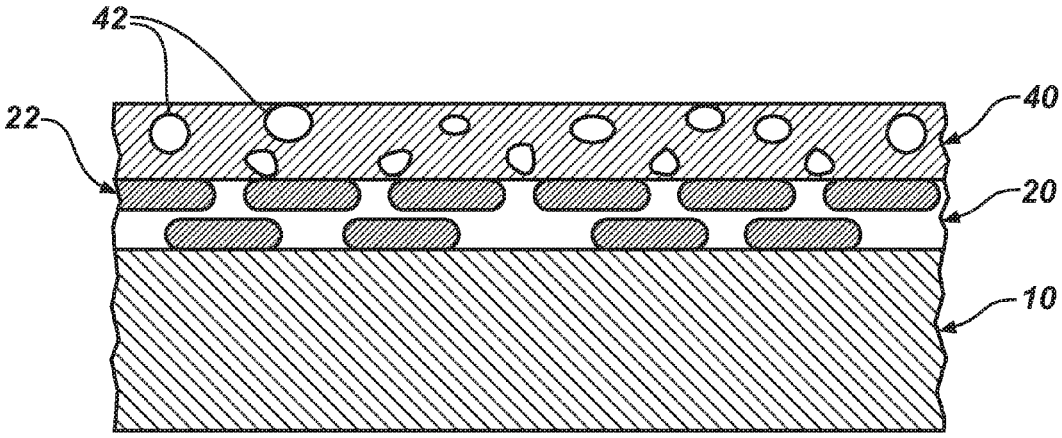
FIG. 1 is a schematic representation of a side-view of a surface portion of a molded article made of sheet molding compound (SMC) that is coated with a conventional conductive coating—comprising inorganic filler particles—and an overlying layer of a cured powder primer.
Figure 2:
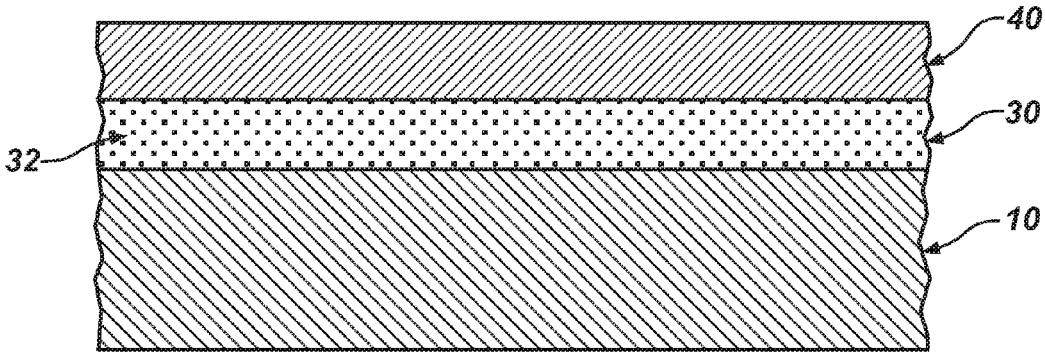
FIG. 2 is a schematic representation of a side-view of a surface portion of a molded article made of sheet molding compound (SMC) that is coated with a polymeric coating—comprising moisture-permeable, organic polymeric filler particles—and an overlying layer of a cured powder primer.

FIGS. 1 and 2 are schematic representations, with each figure depicting a side-view of a surface portion of a molded SMC article 10. The SMC article 10 in FIG. 1 is coated with a conventional conductive coating 20 and an overlying layer of a powder primer 40. The SMC article 10 in FIG. 2 is coated with a polymeric coating 30 according to the present disclosure, and an overlying layer of a powder primer 40. In these figures, the SMC article 10 has been heated to solidify and cure the conventional conductive coating 20 and the polymeric coating 30. And, the SMC article 10 has subsequently been baked in an oven at a temperature and for a time suitable to melt and cure the powder primer layer 40. The conductive coating 20, shown in FIG. 1, contains inorganic filler particles 22. The inorganic filler particles 22 are depicted as solid black ellipses within the cured conductive coating 20. When inorganic filler particles 22 are present in the conductive coating 20, voids 42 are clearly visible within the cured primer layer 40. In comparison, the polymeric coating 30, shown in FIG. 2, contains filler particles of a moisture-permeable, organic polymeric material 32. The particle size of the organic filler particles 32 in the polymeric coating 30 is preferably less than one micron, on average. The organic filler particles 32 are depicted as fine dots within the thin film of the cured polymeric coating 30. The cured primer layer 40 overlying the organic filler-containing polymeric coating 30 is free of bubbles and surface voids.

In preferred embodiments of this invention, the organic filler particles will have a melting point above the temperature required to cure the powder primer layer, and these filler particles will not melt or fuse together in the high-temperature powder primer bake oven.

Filler particles contribute, in part, to the coefficient of linear thermal expansion (CLTE) of the polymeric coating, or the dimensional change the coating experiences when it is exposed to temperature variations. As such, it is desirable for the cured polymeric coating and the molded SMC article to have compatible CLTEs in order to prevent tearing, wrinkling or deformation of the coating on the surface of the SMC article when they are jointly heated and cooled. Therefore, in preferred embodiments of this invention, the CLTE of the organic filler particles is compatible with that of the associated SMC article. For purposes of comparison, conventional SMC composite materials have low CLTEs, typically between $10\times10^{-6}$/° C. and $20\times10^{-6}$/° C.

Suitable organic filler particles are of a liquid crystal polymer (LCP) that has a melting point above 400° F. and a low CLTE. In a further embodiment, the LCP comprises 27 wt. % 4-hydroxy benzoic acid and 73 wt. % 4-hydroxy 2-naphthoic acid and is commonly known as VECTRA A-950. This LCP exhibits a desirable combination of physical and chemical properties that make it suitable for use as the organic filler. For example, the melting point of VECTRA A-950 is greater than 530° F. and its average CLTE is very low (lower than aluminum) In practices of this invention, the filler particles are formed by extruding the LCP into very thin sheets and grinding the sheets into submicron-sized particles.

In another embodiment, the organic filler particles are of a cellulose nanofiber. Cellulose nanofibers may be isolated by heat treatment from long fiber bundles of hemp, flax, rutabaga, wood, or wheat straws, and have a diameter of between 10 to 70 nm. After mechanical defibrillation, the cellulose nanofibers have an aspect ratio of greater than 75, are moisture-permeable and have good mechanical strength and flexibility.

A suitable polymeric coating composition is prepared as a liquid and comprises electrically conductive particles and organic filler particles dispersed within a binder resin precursor material. The polymeric coating composition is applied to the surface of a molded SMC article, which is then heated to solidify and cure the polymeric coating. The polymeric coating composition may be applied by air atomizing spray application. In preferred embodiments of this invention, the binder resin hardens as a result of the initiation of a polymerization reaction.

In another embodiment, the polymeric coating composition may comprise approximately 45-55 wt. % polymeric binder resin precursor material, 10-15 wt. % organic filler particles, 5-10 wt. % electrically conductive particles, and the balance a solvent.

Suitable polymeric binder resins include polyurethane resins, polyester resins, melamine resins, acrylic resins, epoxy resins, polystyrene resins, polypropylene resins, polybutylene resins, or phenolic resins. In preferred embodiments, the binder resin is a polyurethane system, comprising an isocyanate and a hydroxyl group.

Suitable electrically conductive particles are of carbon black and may be mixed with particles of one or more metals, such as particles of nickel, silver, and copper. The particle size of the electrically conductive particles is preferably less than the thickness of the solid cured polymeric coating.

Suitable organic solvents include xylene, toluene, thinner, hexane, methyl ethyl ketone, methyl alcohol, ethyl alcohol, propyl alcohol, butyl alcohol, methyl isobutyl ketone, ethyl acetate, butyl acetate, methyl carbitol, ethyl carbitol, methyl cellosolve and ethyl cellosolve, and mixtures thereof.

The polymeric coating composition may consist of other compounds in quantities less than one percent by weight, such as: a cross-linking or polymerization agent, a reaction inhibitor, a surfactant, an air release agent, a viscosity reducer, a pigment, and even inorganic filler particles. Further additives known in the art may be included in the polymeric coating composition to tailor its material properties and processing characteristics.

The polymeric coating composition can be stored as a single mixture or as separate components that are combined prior to application. A polyurethane system generally consists of two components, an isocyanate and a hydroxyl group, such as a phenolic, amine, hydroxylic or carboxylic compound. The hydroxyl group reacts with the isocyanate to initiate the polymerization reaction. In multiple component formulations, the organic filler particles and electrically conductive particles may be combined in one component or in different components.

The polymeric coating composition of the present invention, comprising filler particles of a moisture-permeable, organic polymeric material, will find utility in a variety of applications where electrostatic powder coating of moisture-absorbing, polymeric materials is desired. In the automotive industry, for example, electrostatic powder coating of vehicle body parts that are molded from SMC is a desirable coating method.

Electrostatic powder coating of vehicle body parts may be accomplished through the following steps. First, a liquid, electrically conductive, polymeric coating composition is applied as a thin film to the surface of a molded SMC article, such as by air atomizing spray. The coated SMC is placed in an oven having a temperature of about 250° F. to 300° F. for 15 to 30 minutes in order to cure the polymeric coating composition and form a solid adherent polymeric coating. A suitable amount of the coating composition is applied so that the solid polymeric coating has a thickness of about 20 to 25 μm. But, the thickness of the polymeric coating can fall within a range of about 10 to 50 μm. A suitable surface conductivity, or resistivity, produced by the solid cured polymeric coating on the SMC article is in the range of about 10,000 and 100,000 ohms per inch.

After the polymeric coating is cured, the coated SMC article is shipped to an automotive plant for further processing. The SMC article is power washed at the plant before it is electrostatically coated with a layer of a powder primer overlying the polymeric coating. The powder-coated SMC article is baked at a temperature of about 350° F., or higher, for 25 to 35 minutes in order to flow and melt the primer particles and form a cured, solid primer layer with a smooth surface. Outgassing moisture from the heated SMC article will not lead to the formation of bubbles or voids in the cured primer layer so long as the SMC article is coated with the organic filler-containing polymeric coating composition of the present invention.

The molded SMC article is coated with a layer of a powder primer in order to fill-in and smooth over any imperfections on the surface of the SMC. Additionally, one or more layers of primer, paint or gloss may be coated onto the surface of the powder-primed SMC article. These additional coating layers are baked in an oven having a temperature of about 280° F. to 320° F. The combination of these coating layers produces a smooth finished surface on the SMC article that is suitable for use in the automotive industry.

Preferred embodiments and practices of this invention have been presented for illustrative purposes and are not to be construed as limiting the scope of the present disclosure.

The invention claimed is:

1. A method of coating a moisture-absorbing, molded sheet molding compound (SMC) article to produce at least two coating layers on a surface of the SMC article so that the coating layers are substantially free of visual defects, the method comprising the following steps in the sequence set forth:

applying a thin film of a polymeric coating composition to the surface of the SMC article to enable the subsequent electrostatic application of a layer of a powder primer, the polymeric coating composition comprising moisture-permeable, organic polymeric filler particles and electrically conductive particles dispersed within a polymeric binder resin precursor material; the filler particles having an average particle size of less than one micron, a melting point above a baking temperature of the polymeric coating composition and the powder primer, and being present in a sufficient amount to provide a cured polymeric coating with a coefficient of linear thermal expansion compatible with that of the SMC article, heating the SMC article to cure the polymeric coating composition and form a solid adherent polymeric coating on the surface of the SMC article, electrostatically applying the layer of powder primer overlying the polymeric coating on the surface of the SMC article; and baking the SMC article to melt and cure the powder primer without melting the organic polymeric filler particles and form a smooth primer layer on the surface of the SMC article, the composition of the polymeric coating and the amount of organic polymeric filler particles therein being such that moisture driven from the baked SMC article diffuses through the polymeric coating and into the overlying primer layer without forming bubbles or voids in the primer layer.

2. The method of coating as recited in claim 1 wherein the solid adherent polymeric coating on the surface of the SMC article has a thickness in the range of about 20 to 25 μm.

3. The method of coating as recited in claim 1 wherein the solid adherent polymeric coating on the surface of the SMC article has a surface resistivity within a range of about 10,000 to 100,000 ohms per inch.

4. The method of coating as recited in claim 1 wherein the polymeric coating composition comprises, by weight, about 45-55% polymeric binder resin precursor material, 5-10% electrically conductive particles, and 10-15% organic filler particles, and the balance an organic solvent, and the composition being adapted for spray application of the polymeric coating to the SMC article.

5. The method of coating as recited in claim 4 wherein the solvent is xylene.

6. The method of coating as recited in claim 1 wherein the polymeric binder resin precursor material is a polyurethane system.

7. The method of coating as recited in claim 1 wherein the electrically conductive particles are particles of carbon.

8. The method of coating as recited in claim 1 wherein the polymeric coating composition comprises, by weight, about 45-55% polyurethane precursor materials, 5-10% carbon particles, and 10-15% particles of a liquid crystal polymer, and the balance an organic solvent, and the composition being adapted for spray application of the polymeric coating to the SMC article.

9. The method of coating as recited in claim 1 wherein the organic filler particles have a melting point of at least 400° F.

10. The method of coating as recited in claim 1 wherein the filler particles are particles of a liquid crystal polymer having a melting point of at least 400° F.

11. The method of coating as recited in claim 1 wherein the filler particles are particles of a liquid crystal polymer that has been extruded into thin sheets and ground into submicron-sized particles.

12. The method of coating as recited in claim 1 wherein the filler particles are particles of a liquid crystal polymer (LCP) comprising a mixture of 4-hydroxy benzoic acid and 4-hydroxy 2-naphthoic acid.

13. The method of coating as recited in claim 1 wherein the filler particles are particles of a liquid crystal polymer comprising a mixture of, by weight, 27% 4-hydroxy benzoic acid and 73% 4-hydroxy 2-naphthoic acid.

14. The method of coating as recited in claim 1 wherein the filler particles are nanofibers of hemp, flax, rutabaga, wood, or wheat straws and mixtures thereof.

15. The method of coating as recited in claim 1 wherein the filler particles are fibers of hemp, flax, rutabaga, wood, or wheat straws that have a diameter in the range of about 10 to 70 nanometers, and have been chopped to lengths that are less than one micron.

16. The method of coating as recited in claim 1 wherein the polymeric binder resin precursor material is a mixture of a polyester resin and a melamine resin.

17. A method of coating a moisture-absorbing, molded sheet molding compound (SMC) article comprising:

applying a thin film of a polymeric coating composition to a surface of the SMC article by spray application, the polymeric coating composition comprising moisture-permeable, organic polymeric filler particles and electrically conductive particles dispersed within a binder resin precursor material, heating the SMC article to polymerize the binder resin precursor material and form a polymeric binder resin without melting the organic polymeric filler particles and form a solid adherent polymeric coating on the surface of the SMC article, electrostatically applying a layer of a powder primer overlying the polymeric coating on the surface of the SMC article; and, thereafter baking the SMC article to form a smooth solid primer layer on the surface of the SMC article.

18. The method of coating as recited in claim 17 wherein the filler particles have an average particle size of less than one micron, a melting point above a baking temperature of the powder primer, and are present in a sufficient amount to provide the solid adherent polymeric coating with a coefficient of linear thermal expansion compatible with that of the SMC article.

* * * * *